US009017035B2

(12) United States Patent
Marmilic et al.

(10) Patent No.: US 9,017,035 B2
(45) Date of Patent: Apr. 28, 2015

(54) TURBINE BLADE

(75) Inventors: Robert Marmilic, Nussbaumen (CH); Carlos Simon-Delgado, Baden (CH); Herbert Brandl, Waldshut-Tiengen (DE)

(73) Assignee: Alstom Technology Ltd., Baden (CH)

( * ) Notice: Subject to any disclaimer, the term of this patent is extended or adjusted under 35 U.S.C. 154(b) by 882 days.

(21) Appl. No.: 12/958,727

(22) Filed: Dec. 2, 2010

(65) Prior Publication Data

US 2011/0135497 A1 Jun. 9, 2011

(30) Foreign Application Priority Data

Dec. 3, 2009 (EP) ..... 09177829

(51) Int. Cl.
*F01D 5/18* (2006.01)
*F01D 5/14* (2006.01)

(52) U.S. Cl.
CPC *F01D 5/14* (2013.01); *F01D 5/141* (2013.01); *F01D 5/146* (2013.01); *F01D 5/147* (2013.01); *F01D 5/189* (2013.01)

(58) Field of Classification Search
USPC ..... 416/95, 97 R, 96 A, 96 R, 223 A, 223 R, 416/224
See application file for complete search history.

(56) References Cited

U.S. PATENT DOCUMENTS

| | | | | |
|---|---|---|---|---|
| 2,930,580 | A | 3/1960 | Hayes | |
| 4,321,010 | A | 3/1982 | Wilkinson et al. | |
| 4,421,153 | A | 12/1983 | Wilkinson et al. | |
| 5,203,873 | A | 4/1993 | Corsmeier et al. | |
| 6,257,830 | B1 * | 7/2001 | Matsuura et al. | 416/96 R |
| 6,331,217 | B1 | 12/2001 | Burke et al. | |
| 6,382,908 | B1 | 5/2002 | Keith et al. | |
| 6,742,991 | B2 | 6/2004 | Soechting et al. | |
| 7,094,031 | B2 * | 8/2006 | Lee et al. | 416/97 R |
| 7,322,796 | B2 | 1/2008 | Pietraszkiewicz et al. | |
| 7,371,049 | B2 * | 5/2008 | Cunha et al. | 416/97 A |
| 2004/0009066 | A1 | 1/2004 | Soechting et al. | |
| 2004/0022630 | A1 * | 2/2004 | Tiemann | 416/97 R |
| 2007/0048135 | A1 | 3/2007 | Pietraszkiewicz et al. | |

FOREIGN PATENT DOCUMENTS

| | | | |
|---|---|---|---|
| CN | 1162345 | A | 10/1997 |
| JP | 55-029099 | A | 3/1980 |
| JP | 05-010102 | A | 1/1993 |

(Continued)

OTHER PUBLICATIONS

Chinese Office Action dated Mar. 31, 2014, issued by the State Intellectual Property Office of the People's Republic of China in corresponding Chinese Patent Application No. 201010585344.5 and English language translation of Office Action. (19 pages).

(Continued)

*Primary Examiner* — Edward Look
*Assistant Examiner* — Maxime Adjagbe
(74) *Attorney, Agent, or Firm* — Buchanan Ingersoll & Rooney PC

(57) ABSTRACT

A blade is provided and includes a platform and a root configured to be connected to a blade carrier. Airfoil portions extend from opposite sides of the platform. Each airfoil portion defines an operating surface being the surface facing the other airfoil portion. An operating surface of one of the airfoil portions defines a suction side and the other operating surface of the other airfoil portion defines a pressure side.

14 Claims, 7 Drawing Sheets

(56) References Cited

FOREIGN PATENT DOCUMENTS

| | | | |
|---|---|---|---|
| JP | 05-133245 | A | 5/1993 |
| JP | 2003-214107 | A | 7/2003 |
| JP | 2004-044572 | A | 2/2004 |
| JP | 2006-242050 | A | 9/2006 |
| JP | 2007-064215 | A | 3/2007 |
| WO | 96/13653 | A1 | 5/1996 |
| WO | 0053895 | A1 | 9/2000 |

OTHER PUBLICATIONS

Office Action (Notification of Reasons for Refusal) issued on Sep. 16, 2014, by the Japanese Patent Office in corresponding Japanese Patent Application No. 2010-268897 and an English translation of the Office Action. (7 pages).

* cited by examiner

TURBINE BLADE

FIELD OF INVENTION

The present invention relates to a turbine blade. In particular the turbine blade of the present invention may be a rotor blade and/or a guide vane (i.e. stator blade) of a gas turbine or a steam turbine.

For sake of simplicity and brevity, in the following reference to a turbine rotor blade of a gas turbine will be made.

BACKGROUND

Turbine rotor blades of gas turbines are known to comprise a platform having a root with typically a dovetail/fir tree shape to be connected to a corresponding seat of a blade carrier.

From the central portion of the platform an airfoil extends, shaped with a pressure side and a suction side arranged to cooperate with hot gases that pass through the turbine.

When assembled on the blade carrier, the turbine rotor blades are all arranged one adjacent to the other, such that their platforms define the inner surface of the annular hot gases path.

Nevertheless, these blades have a number of drawbacks, enumerated in detail in the following:

AERODYNAMICAL PROBLEMS—During operation a large amount of purge air must be injected into the hot gases path through the gaps between two adjacent platforms and additional purge air must be injected from the casing encircling the rotor turbine blades. This air injected into the hot gases path decreases the efficiency of the gas turbine.

In addition, the gaps between the tip of each airfoil and the casing let a leakage pass through; these leakages further decrease the efficiency of the gas turbine.

MANUFACTURING PROBLEMS—Blades have usually a number of internal cooling channels through which, during operation, cooling air is driven.

For this reason, blades are usually manufactured by casting them with an internal ceramic core forming the cooling channels. This casting technique is very expensive and time consuming; in addition the channels (formed in the ceramic core) usually are not provided with all ideal features from the cooling point of view, but they are optimised for making the manufacturing process easier and cheaper.

COOLING PROBLEMS—Because of the manufacturing constrains, the cooling channels could not provide an efficient cooling, such that during operation overheating and difficult cooling could become a problem.

SUMMARY

The present disclosure is directed to a blade including a platform and at least a root configured to be connected to a blade carrier. Airfoil portions extend from opposite sides of the platform, each defining an operating surface, which is a surface facing the other airfoil portion, An operating surface of one of the airfoil portions defines a suction side and the other operating surface of the other airfoil portion defines a pressure side.

BRIEF DESCRIPTION OF THE DRAWINGS

Further characteristics and advantages of the invention will be more apparent from the description of a preferred but non-exclusive embodiment of the blade according to the invention, illustrated by way of non-limiting example in the accompanying drawings, in which:

FIG. 11 shows blades with platforms different from those of FIG. 1 with a sealing plate in-between.

DETAILED DESCRIPTION OF THE PREFERRED EMBODIMENTS

Introduction to the Embodiments

The technical aim of the present invention is therefore to provide a blade by which the said problems of the known art are eliminated.

Within the scope of this technical aim, an aspect of the invention is to provide a blade with which the purge air injected into the hot gases path may be reduced with respect to the air needed with traditional blades, thus achieving an increased efficiency.

Moreover, in a particularly advantageous embodiment of the invention, the leakages between the tip of each airfoil and the casing encircling it are also reduced, such that efficiency is further increased.

Another aspect of the invention is to provide a blade which lets heat transfer enhancers (such as for example inner cooling channels or fins) of each airfoil be easily manufactured with costs lower than those needed for corresponding traditional blades and in a time effective way.

A further aspect of the invention is to manufacture optimised heat transfer enhancers, i.e. heat transfer enhancers whose structure and shape is mainly defined by the desired cooling effect instead of manufacturing constrains.

The technical aim, together with these and further aspects, are attained according to the invention by providing a blade in accordance with the accompanying claims. In a particularly advantageous embodiment of the invention airfoil vibration problems are reduced.

DETAILED DESCRIPTION

In the following reference to a rotor blade of a gas turbine will be made; it is anyhow clear that in different embodiments of the invention the blade could also be a guide vane of a gas turbine or in even further embodiments also a rotor or stator blade of a steam turbine or different rotating machine.

Figure 1:
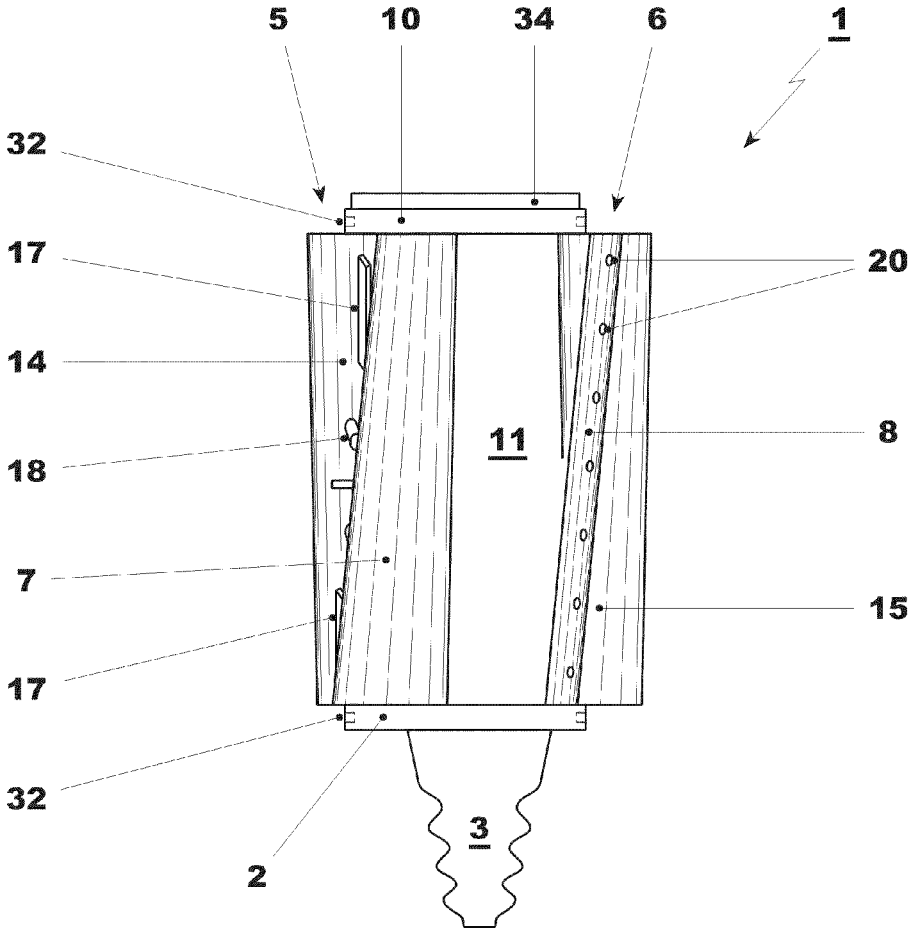
FIG. 1 is a schematic front view of a blade in a first embodiment of the invention.
Figure 5:
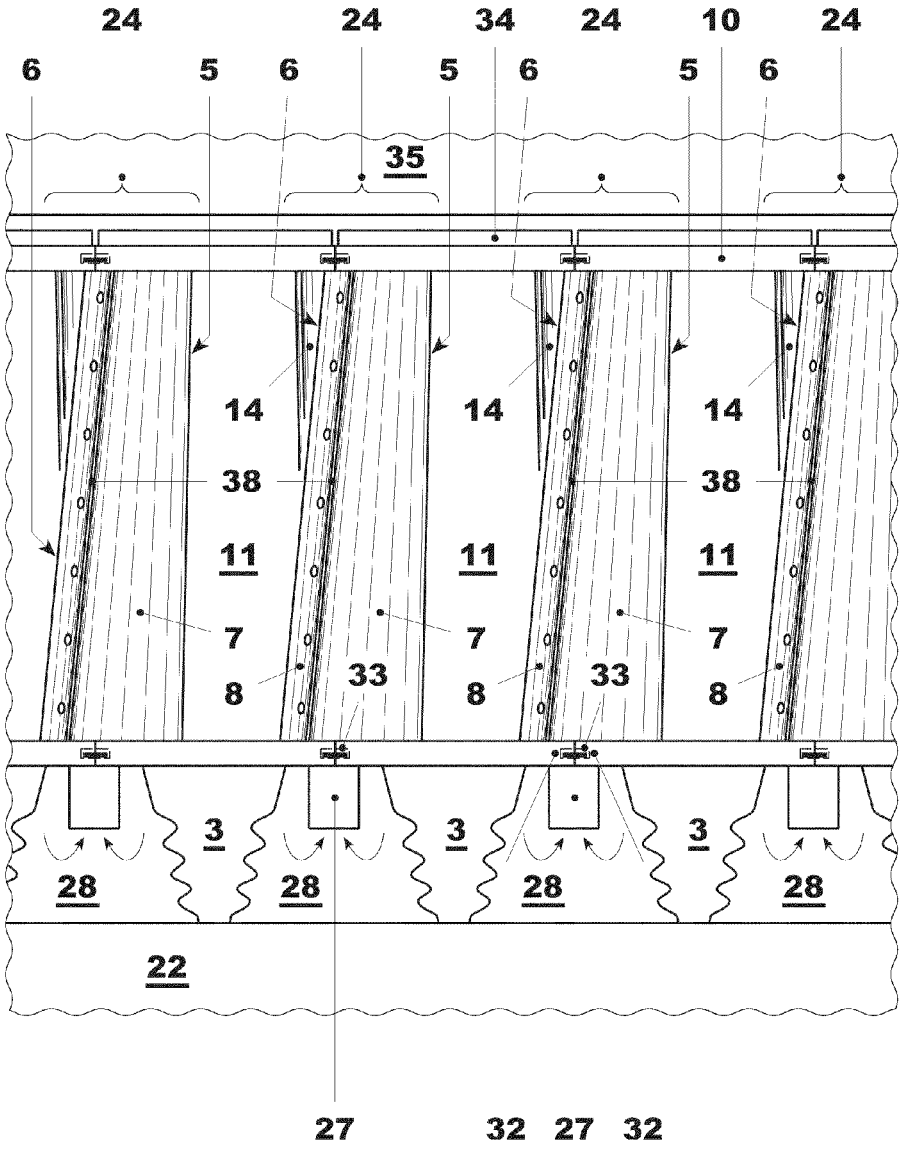
FIG. 5 shows a schematic front view of a number of blades of FIG. 1 one adjacent to the other.

With particular reference to FIG. 1, a turbine blade 1 is shown comprising a platform 2 provided with a root 3 arranged to be connected to a blade carrier (not shown in FIG. 1 but indicated by 22 in FIG. 5).

From the opposite sides of the platform 2 of the blade 1, airfoil portions 5, 6 extend.

Each airfoil portion defines one operating surface 7, 8 being the surface facing the other airfoil portion.

Figure 2:
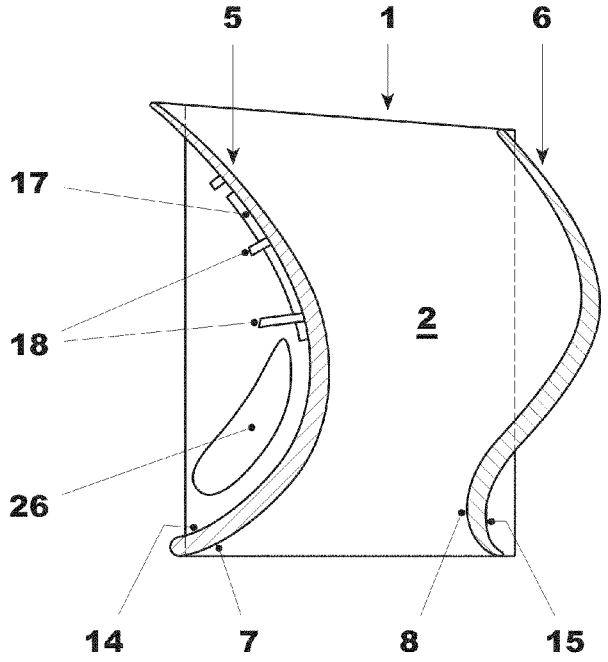
FIG. 2 is a schematic cross section at the middle of the airfoil portions of the blade in the embodiment of FIG. 1.
Figure 3:
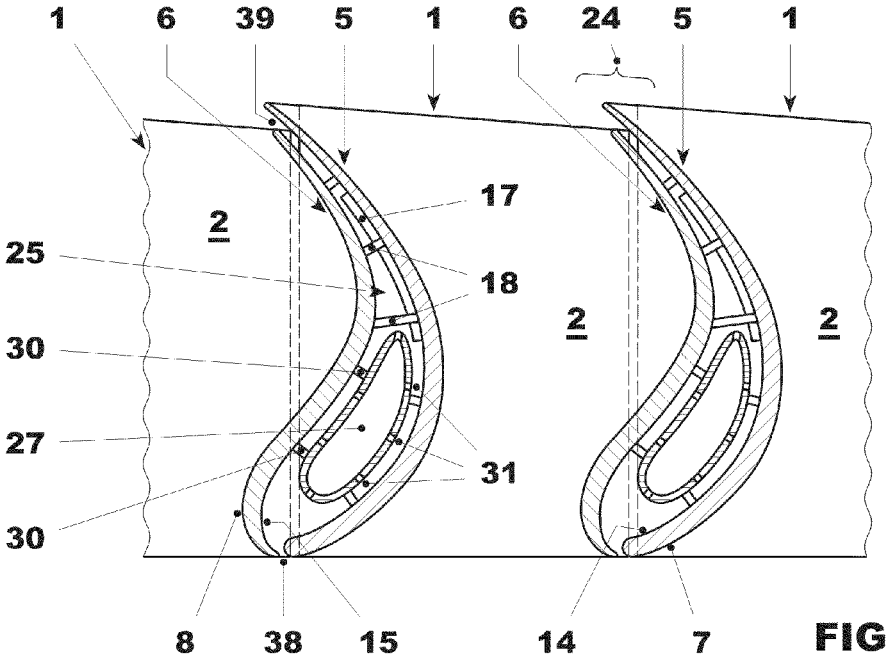
FIG. 3 is a schematic cross section similar to that of FIG. 2, with a number of blades one adjacent to the other.

In this respect, with reference to FIGS. 2 and 3, the surface 8 of the airfoil portion 6 that faces the other airfoil portion 5 of the same blade 1 is an operating surface of the blade 1, i.e. a surface that, when the blade is assembled in a gas turbine and during operation of the same gas turbine is arranged to come into contact with the hot gases flowing into the hot gases path.

Likewise, FIG. 2 shows the operating surface 7 of the airfoil portion 5 being the surface of the airfoil 5 facing the other airfoil portion 6 of the same blade 1 and arranged to come into contact with the hot gases during operation.

In particular, the operating surface 7 of the airfoil portions 5 defines a suction side and the operating surface 8 of the airfoil portion 6 defines a pressure side of airfoils to be defined when a number of blades 1 are connected each other.

The blade 1 also comprises a shroud 10 connected at the ends of each airfoil portion 5 and 6, such that the platform 2 with the airfoil portions 5 and 6 and the shroud 10 define a closed channel 11.

The surfaces 14, 15 of the airfoil portions 5, 6 opposite the operating surfaces 7, 8 define inner surfaces of airfoils that, when a number of blades are assembled on a blade carrier, are defined by two adjacent airfoil portions; these inner surfaces 14, 15 do not come into contact with the hot gases during normal operation of the gas turbine.

Since during manufacturing these inner surfaces 14 and 15 are directly accessible for the operators and manufacturing tools, they can be shaped according to the needs in a very easy and fast way, with traditional tools and at limited costs; in other words shaping of these inner surfaces also with very complicated heat transfer enhancers 17 is easier and cheaper than in traditional blades.

For example the heat transfer enhancers 17 are ribs or pins or fins arranged to increase thermal exchanges extending from the inner surfaces 14 and/or 15.

Moreover, preferably the inner surfaces 14, 15 of the airfoil portions 5 and/or 6 comprise spacers 18, such that when a number of blades 1 are assembled on a blade carrier one adjacent to the other, the spacers 18 are interposed between two adjacent airfoil portions 5, 6.

Figure 10:
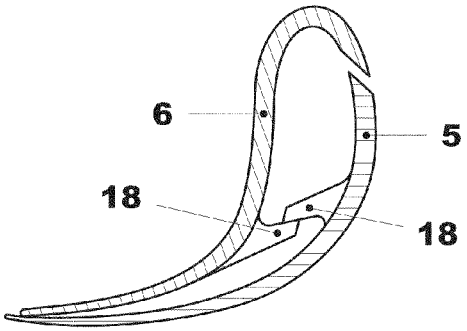
FIG. 10 shows a particular embodiment of spacers between adjacent airfoil portions.

FIG. 10 shows a preferred embodiment of the spacers 18; in this embodiment both the blade portion 5 and 6 have a spacer 18; these spacers are slidingly connected each other.

At least one of the airfoil portions 5, 6 has through holes 20 arranged to let cooling air passing therethrough.

Figure 4:
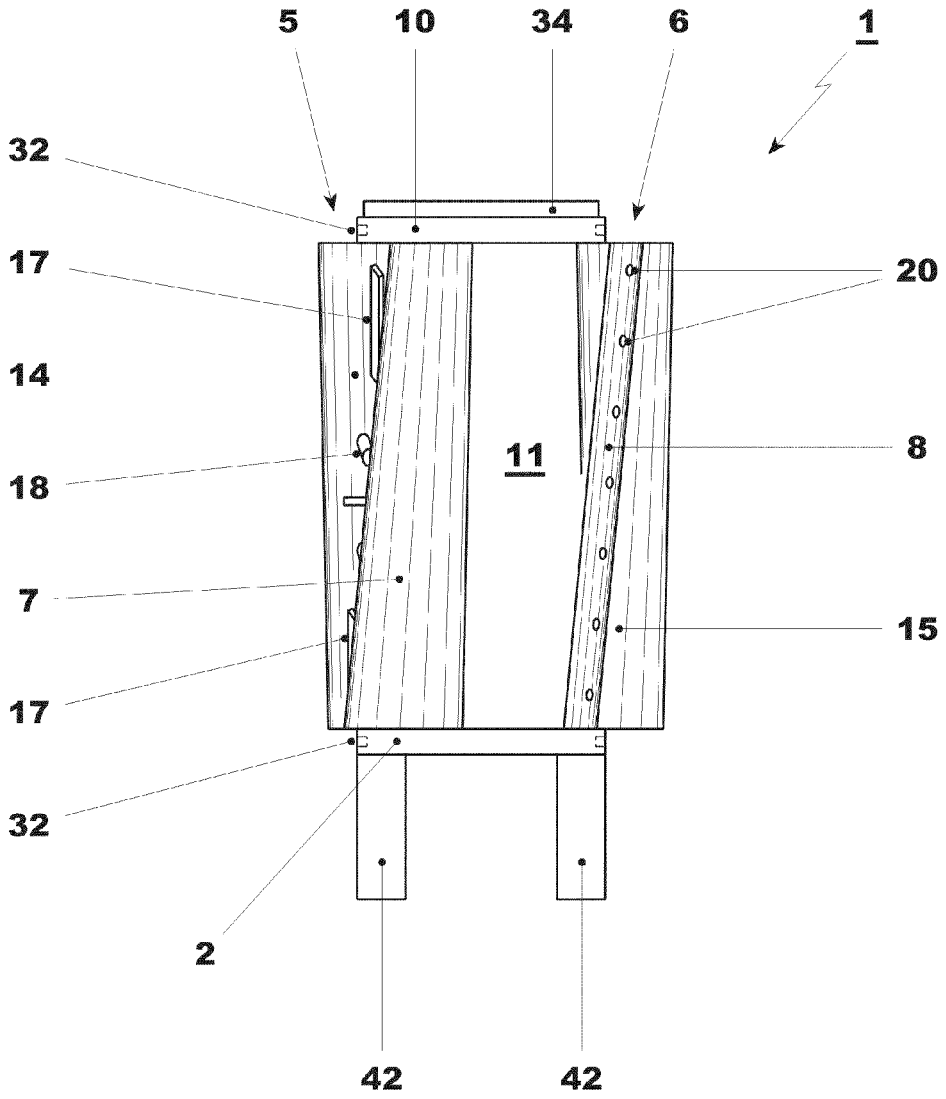
FIG. 4 is a schematic front view of a blade in a second embodiment of the invention.

FIGS. 1 and 4 show only the airfoil portion 6 provided with these through holes, it is however clear that in different embodiments both airfoil portions 5 and 6 may be provided with these through holes 20 or only the airfoil portion 5 may have the through holes 20.

In addition, in even further embodiments, the through holes 20 may also be provided at the platform 2 and/or at the shroud 10.

FIGS. 3 and 5 show a blade 1 connected to other blades 1, assembled onto a blade carrier 22.

As shown in these figures, the airfoil portion 6 with operating surface 8 defining a pressure side of a blade 1 is connected to an airfoil portion 5 with operating surface 7 defining a suction side of a different, adjacent blade 1; the two airfoils portions 5 and 6 of the two different adjacent blades 1 connected each other together define an airfoil 24.

FIG. 3 shows that between the connected airfoil portions 5 and 6 (i.e. inside of each airfoil 24 defined by them), a chamber 25 is defined.

The lower part of the chamber 25 is closed by the platforms 2 of two adjacent blades 1 and its upper part is closed by the shrouds 10 of two adjacent blades 1.

The platform 2 has preferably straight side borders to make it easier housing a seal (FIG. 2).

Figure 11:
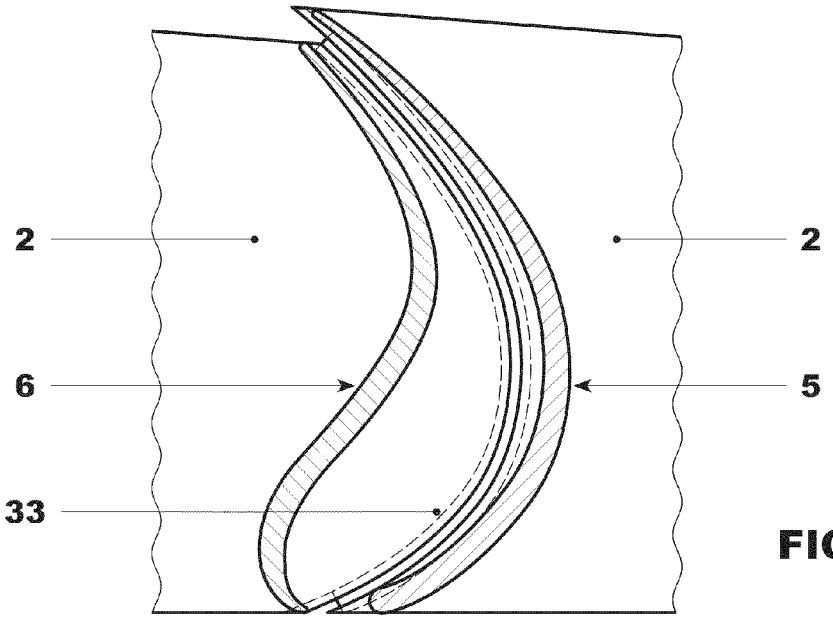

In different embodiments (FIG. 11) the platform 2 has its side borders shaped with a curved profile.

Likewise, the shroud 10 has straight side borders to make it easier to house a seal.

In different embodiments the shroud 10 may also have side borders shaped with a curved profile.

It is however clear that the side borders of the platform and shroud may comprise every combination of the above cited types (for example platform with straight side borders and shroud with a curved profile or vice versa).

The chamber 25 may be empty or house the heat transfer enhancers (for example ribs and/or pins and/or fins 17) and/or the spacers 18.

In addition, the chamber 25 may also house a tubular insert 27 arranged to feed compressed cooling air inside of the chamber 25.

In particular the tubular insert 27 passes through a hole 26 of the platform 2 and has an end inside of the chamber 25 and an opposite end outside of the chamber 25, in the region 28 of the roots 3 of the blades.

The tubular insert 27 may have different shapes such as for example circular or oval shape, nevertheless it has preferably a shape similar to the inner profile of the inside surfaces 14 and 15.

Moreover, the tubular insert 27 may be separated from the airfoil portions 5 and 6 and may be provided with spacers 30 arranged to rest against the inner surfaces 14 and 15 of the airfoil portions 5 and 6.

In further embodiments the tubular insert 27 can be provided without the spacers 30; the spacers 30 could extend from the inner surfaces 14 and 15 of the airfoil portions 5 and 6; in this embodiment the spacer 30 can have the same structure shown in FIG. 10 for the spacer 18.

The tubular insert 27 has a number of calibrated through holes 31, arranged to let the cooling air pass through, to control the cooling air passing therethrough and thus entering the chamber 25.

Between the adjacent borders of the platforms 2 and shrouds 10 seals are provided.

With the blade in the embodiment shown in FIG. 1 seals similar to traditional seals such as straight bar shaped plates 33 may be provided; these seals are inserted in facing slots 32 indented in the side borders of the platform 2 and shroud 10.

In different embodiments (FIG. 11) the plate 33 is substantially C-shaped and is inserted in facing slots 32 indented in the curved side borders of adjacent platform 2 and shrouds 10.

In addition, the blades 1 also comprise seals 34 at the shrouds 10 for preventing the hot gases from passing through the gap between the shrouds 10 and a casing 35 of the gas turbine.

As shown in FIG. 3, advantageously the airfoil portions 5 and 6 define gaps 38, 39 between their facing edges at the leading edges and trailing edges; through these gaps 38, 39 compressed air fed via the tubular insert 27 into the chamber 25 may be injected.

Figure 7:
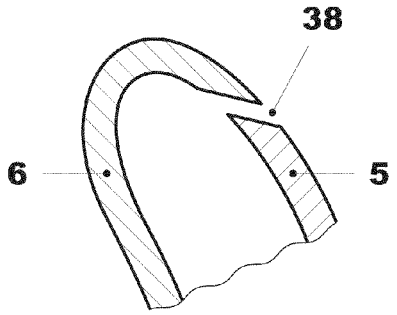
FIGS. 7-9 show different embodiments of gaps between airfoil portions of adjacent blades.

FIG. 7 shows a first possible configuration for the gap 38 between the airfoil portions 5 and 6. In this configuration the gap 38 defines a slit.

Figure 8:
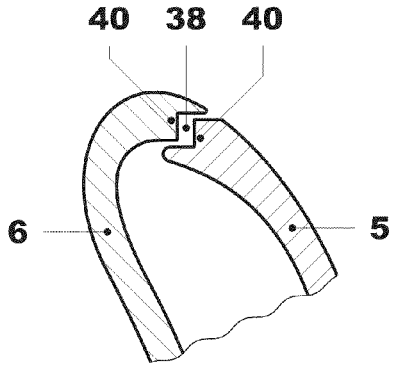

FIG. 8 shows a second possible configuration for the gap 38 between the airfoil portions 5 and 6. In this configuration the edges that define the gap 38 have a step 40 to define a kind of labyrinth seal.

Figure 9:
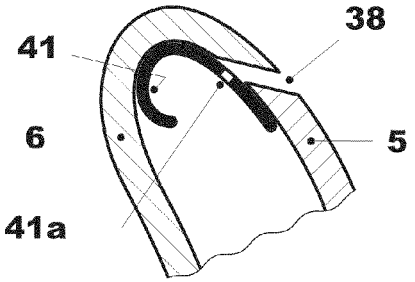

FIG. 9 shows a third possible configuration for the gap 38 between the airfoil portions 5 and 6. In this configuration the airfoil portion 5 has a spring 41, provided with through holes 41*a* to let the air pass through; the spring 41 rests against the airfoil portion 6.

In other embodiments, instead of one spring, the airfoil portion 5 may have a plurality of springs with slits between them; in addition the springs 41 may also be connected to the airfoil portion 6 and have its end resting against the airfoil portion 5 or, when a plurality of springs 41 are provided, some of them may be connected to the airfoil portion 5 and other to the airfoil portion 6.

The gap 39 may have the same configuration as the gap 38 or also a different configuration similar to those already described with reference to the gap 38.

The operation of the blade 1 is apparent from what described and illustrated and is substantially the following.

The hot gases, generated in a combustion chamber by burning a mixture of compressed air coming from a compressor and fuel, are expanded in the turbine.

In particular, in the turbine the hot gases, driven by the guide vane, pass through the rotor blades 1.

When passing through the rotor blades 1, the hot gases pass through the channels 11 defined between the platform 2, the airfoil portions 5 and 6 and the shroud 10, delivering mechanical power to the rotor.

While passing through the channels 11 the aerodynamic losses are low (when compared to similar traditional blades) because the amount of purge air injected is reduced.

In addition, there is no hot gases leakage from the pressure side to the suction side at the tip of the airfoils 24 thanks to the shrouds 10.

Therefore the total efficiency of the blade is increased when compared to similar traditional blades.

Moreover, because of the particular structure with the inner surfaces 14 and 15 of the airfoil portions 5 and 6 that during manufacturing and refurbishing processes are directly accessible for the operators (they become inaccessible only when the blades 1 are assembled onto the blade carrier 22) manufacturing is simple, quick and cheap when compared to manufacturing of traditional blades.

Thus it is particularly easy manufacturing of the heat transfer enhancers 17 (for example ribs and/or pins and/or fins) for increasing thermal exchanges.

Moreover, spacers 18 and 30 can also be manufactured in an easy, cheap and fast way, and can for example be realized in one piece with the airfoil portions or may be manufactured separately and then connected thereto for example by brazing or welding.

Thus, the heat transfer enhancers 17 can be optimised in relation to the desired cooling effect instead of the manufacturing constrains; this lets the cooling problems to be sensibly reduced in comparison to similar traditional blades.

In addition, the shroud lets the vibration problems of the airfoils be reduced.

The particular structure of the airfoils 24 that are realized in two elements with inner surfaces 14 and 15 directly accessible during manufacturing lets also the mechanical structure of the blade be optimised in order to further reduce airfoil vibrations.

Also different embodiments of the invention are possible.

Figure 4A:
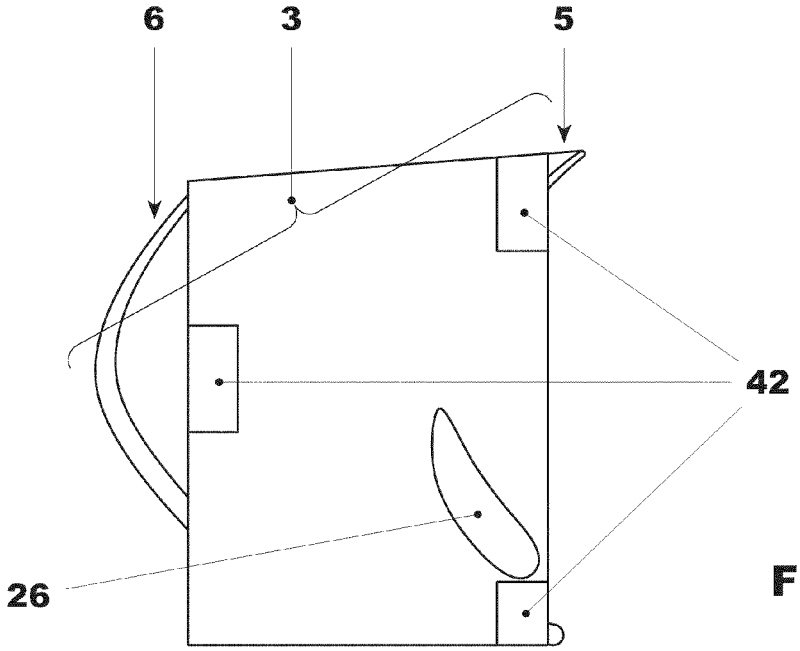
FIG. 4*a* is a schematic view from the bottom of the blade of FIG. 4.
Figure 4B:
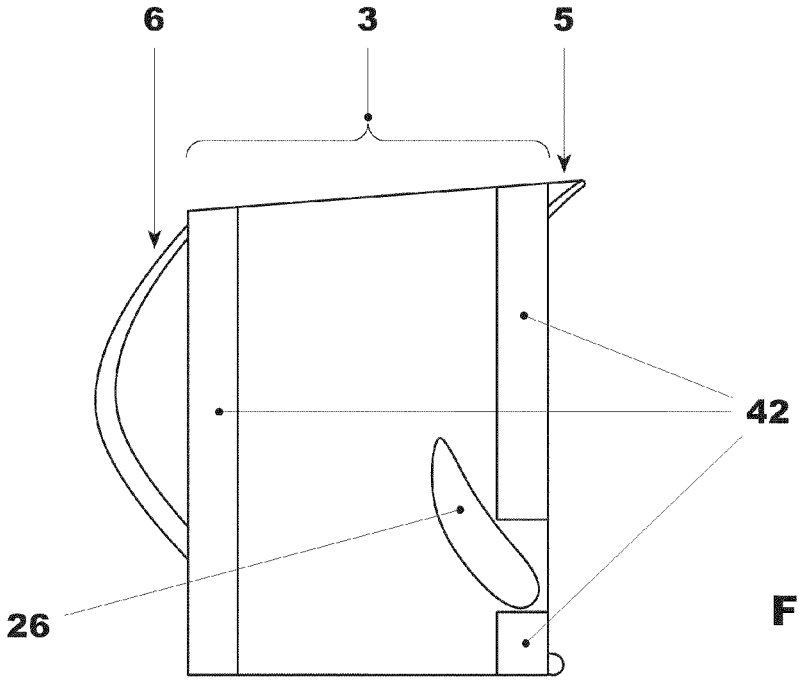
FIG. 4*b* is a schematic view from the bottom of a blade similar to the blade of FIG. 4 but having a different root.

FIGS. 4 and 4*a* shows a different embodiment with the root 3 defined by three carrying ribs 42 and FIG. 4*b* shows a further embodiments with the root 3 defined by carrying ribs 42.

Figure 6:
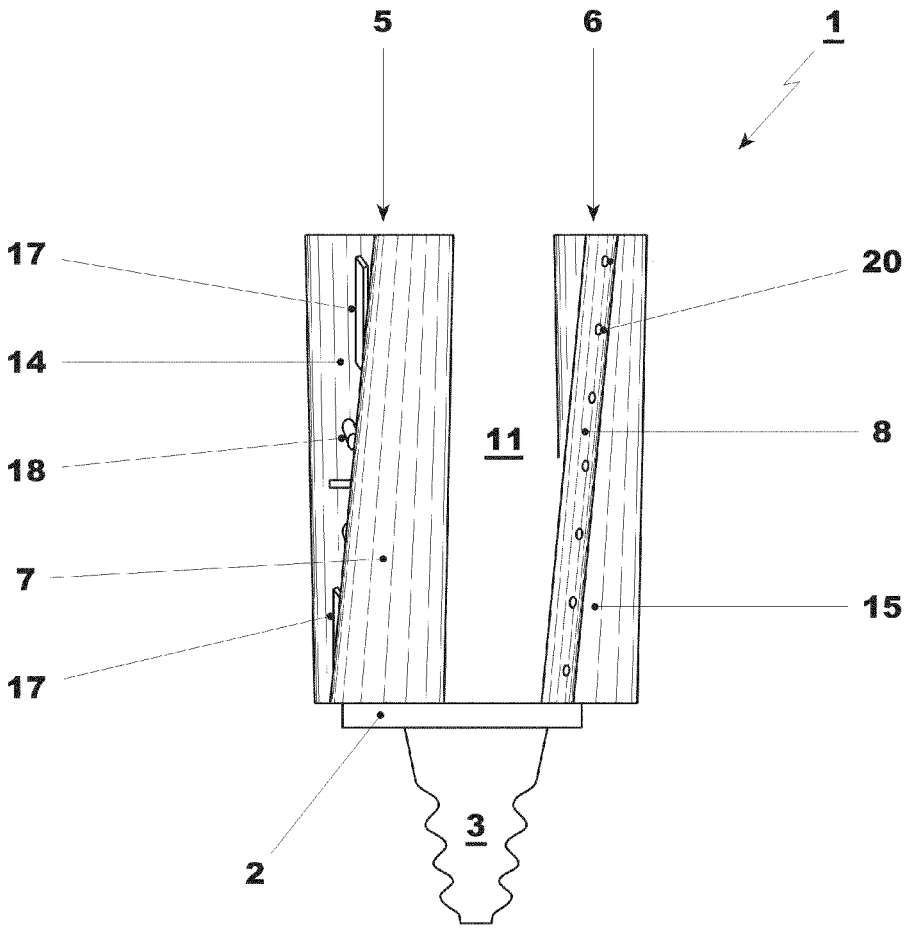
FIG. 6 is a schematic front view of a blade in a further embodiment of the invention without the shroud.

FIG. 6 shows an embodiment of a blade 1 similar to the blade already described, in this respect the same references are used in FIG. 6 to define the same or similar elements.

In particular, the blade of FIG. 6 has substantially the same features as the blade of FIG. 1, but it is not provided with the shroud 10.

Naturally the features described may also be independently provided from one another.

The turbine blade (being a rotor blade and/or a guide vane (i.e. a stator blade) conceived in this manner is susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

1 turbine blade
2 platform
3 root
5 airfoil portion
6 airfoil portion
7 operating surface of 5
8 operating surface of 6
10 shroud
11 channel
14 inner surface of 5
15 inner surface of 6
17 heat transfer enhancers
18 spacers
20 through holes
22 blade carrier
24 airfoil
25 chamber
26 hole
27 tubular insert
28 region of the roots
30 spacers
31 calibrated through holes
32 slots
33 plates
34 seals
35 casing
38 gap at the leading edge
39 gap at the trailing edge
40 steps
41 springs
41*a* through holes
42 carrying ribs

What is claimed is:

1. A blade comprising:

a platform; and at least one root configured to be connected to a blade carrier, wherein airfoil portions extend from opposite circumferential sides of the platform, each airfoil portion defining an operating surface being a surface facing the other airfoil portion, wherein an operating surface of one of the airfoil portions defines a suction side and the other operating surface of the other airfoil portion defines a pressure side, wherein, when assembled, the two airfoils portions of the blade and another blade adjacent thereto and connected to each other together define an airfoil, and wherein the airfoil portions each extend to a trailing edge of the airfoil and define a gap between a facing edge at the corresponding trailing edge, respectively, the gap extending the length of the trailing edge of the airfoil.

2. The blade as claimed in claim 1, further comprising:

a shroud connected at ends of the airfoil portions, wherein the platform with the airfoil portions and the shroud define a closed channel.

3. The blade as claimed in claim 1, wherein a surface of each airfoil portion opposite the operating surface defines an inner surface of the airfoil that, when a number of blades are assembled on the blade carrier, is defined by two adjacent airfoil portions.

4. The blade as claimed in claim 3, wherein the inner surface of at least one of the airfoil portions has heat transfer enhancers arranged to increase thermal exchanges.

5. The blade as claimed in claim 3, wherein the inner surface of at least one of the airfoil portions comprises spacers, and wherein when a number of blades are assembled on the blade carrier, the spacers are interposed between two adjacent airfoil portions.

6. The blade as claimed in claim 2, wherein at least one of the airfoil portions, the platform and the shroud has through holes arranged to let cooling air to pass therethrough.

7. The blade as claimed in claim 1, wherein the blade is assembled onto the blade carrier adjacent to other blades, and wherein the airfoil portion with the operating surface defining a pressure side of the blade is connected to the airfoil portion with the operating surface defining a suction side of an adjacent blade.

8. The blade as claimed in claim 1, wherein a chamber is defined between adjacent airfoil portions.

9. The blade as claimed in claim 8, further comprising a tubular insert having an end inside of the chamber and an opposite end outside of the chamber in the region of the roots of the blades.

10. The blade as claimed in claim 9, wherein the tubular insert comprises a number of calibrated through holes arranged to control the cooling air entering the chamber.

11. The blade as claimed in claim 9, wherein the platform has a hole to let the tubular insert pass through.

12. The blade as claimed in claim 2, further comprising:

seals provided at least one of: at side borders of the platform and at side borders of the shroud.

13. The blade as claimed in claim 2, further comprising:

a seal at the shroud.

14. The blade as claimed in claim 1, wherein the blade is a rotor blade or a guide vane.

* * * * *